US005221035A

United States Patent [19]

Suzuki et al.

[11] Patent Number: 5,221,035

[45] Date of Patent: Jun. 22, 1993

[54] PRINTING MEDIUM FEEDING DEVICE OF AN IMAGE REPRODUCTION APPARATUS

[75] Inventors: Toshikazu Suzuki; Kenji Nomura, both of Tokyo, Japan

[73] Assignee: Seiko Instruments Inc., Japan

[21] Appl. No.: 791,911

[22] Filed: Nov. 13, 1991

[30] Foreign Application Priority Data

Nov. 29, 1990 [JP] Japan ..... 2-130366[U]

[51] Int. Cl.[5] ..... B41J 15/00

[52] U.S. Cl. ..... 226/181; 226/187; 400/636.3

[58] Field of Search ..... 226/181, 186, 187; 400/636, 636.3, 613.1

[56] References Cited

U.S. PATENT DOCUMENTS

| | | | |
|---|---|---|---|
| 3,754,695 | 8/1973 | Suzuki | 226/181 X |
| 4,341,480 | 7/1982 | Mailer | 400/636 X |
| 4,368,837 | 1/1983 | Bodewein | 226/186 X |
| 4,479,598 | 10/1984 | Mailer et al. | 226/186 X |
| 4,688,958 | 8/1987 | Tajima | 400/636.3 |
| 5,129,749 | 7/1992 | Sato | 226/187 X |

FOREIGN PATENT DOCUMENTS

| | | | |
|---|---|---|---|
| 0155080 | 9/1984 | Japan | 400/636 |
| 0038183 | 2/1985 | Japan | 400/636 |
| 0037456 | 2/1986 | Japan | 400/636 |
| 2152878 | 8/1985 | United Kingdom | 400/636 |

OTHER PUBLICATIONS

IBM Technical Disclosure Bulletin, "Selectively Controllable Document Feed Device", Massey, vol. 8, No. 11, Apr., 1966.

*Primary Examiner*—Daniel P. Stodola
*Assistant Examiner*—Paul T. Bowen
*Attorney, Agent, or Firm*—Bruce L. Adams; Van C. Wilks

[57] ABSTRACT

A printing medium feeding device for an image reproduction apparatus has a feed roller driveable in forward and reverse directions. A pinch roller is rotatably supported by a pivotable arm and rotatably supports a hook. The hook is effective when in an engaged position to hook onto a feed roller shaft so as to position the pinch roller and feed roller to sandwich therebetween a printing medium. The pinch roller is rotated by the rotation of the feed roller. An actuating plate carrying a one-way transmission is rotatable by the shaft of the pinch roller only when the feed roller is driven in the reverse direction. The actuating plate moves the hook to release the engagement with the feed roller shaft to release the pinching of the printing medium between the pinch roller and the feed roller at appropriate times, such as during printing.

9 Claims, 3 Drawing Sheets

PRINTING MEDIUM FEEDING DEVICE OF AN IMAGE REPRODUCTION APPARATUS

BACKGROUND OF THE INVENTION

The present invention relates to a device for feeding a printing medium such as a paper sheet and an OHP sheet into a computer output terminal apparatus in the form of an image reproduction apparatus to effect hard copying or image reproduction.

Conventionally, the printing medium wound in a roll or web is sandwiched between a feed roller and a pinch roller to simply feed forward the same to an operation start point in the image reproduction apparatus. The pinch roller is not released during the image reproduction operation. Alternatively, the pinch roller is released by means of a motor or solenoid which requires a power source.

In the printing medium feeding device, the feed roller and the conventional pinch roller are provided to sandwich the printing medium to feed the same to the operation start point or position in the image reproduction apparatus. After the feeding, it is desired that the fed medium is made free of contact with either of the pinch roller and the feed roller. If the feed roller and the pinch roller are not spaced from the printing medium, the printing medium may receive mechanical vibration and excessive pressure due to dimensional error of components including the feed roller and the pinch roller, thereby reducing the image quality. In addition, power or energy may be wasted during the image forming due to unnecessary application of pressure in the image reproduction apparatus.

In another prior art device, in order to remove the feed roller and the pinch roller from the printing medium, an actuator is used such as a motor or a electromagnetic solenoid, which requires a power source. However, the use of these actuators increase cost, reduce assembling productivity due to increase in components, and degrade the reliability of the device.

SUMMARY OF THE INVENTION

An object of the present invention is to overcome the problems of the prior art. In accordance with the present invention, an improved feeding device constructed such that the pinch roller can be mechanically released from the feed roller when the printing medium is placed in a set position.

DETAILED DESCRIPTION OF THE INVENTION

Figure 1:
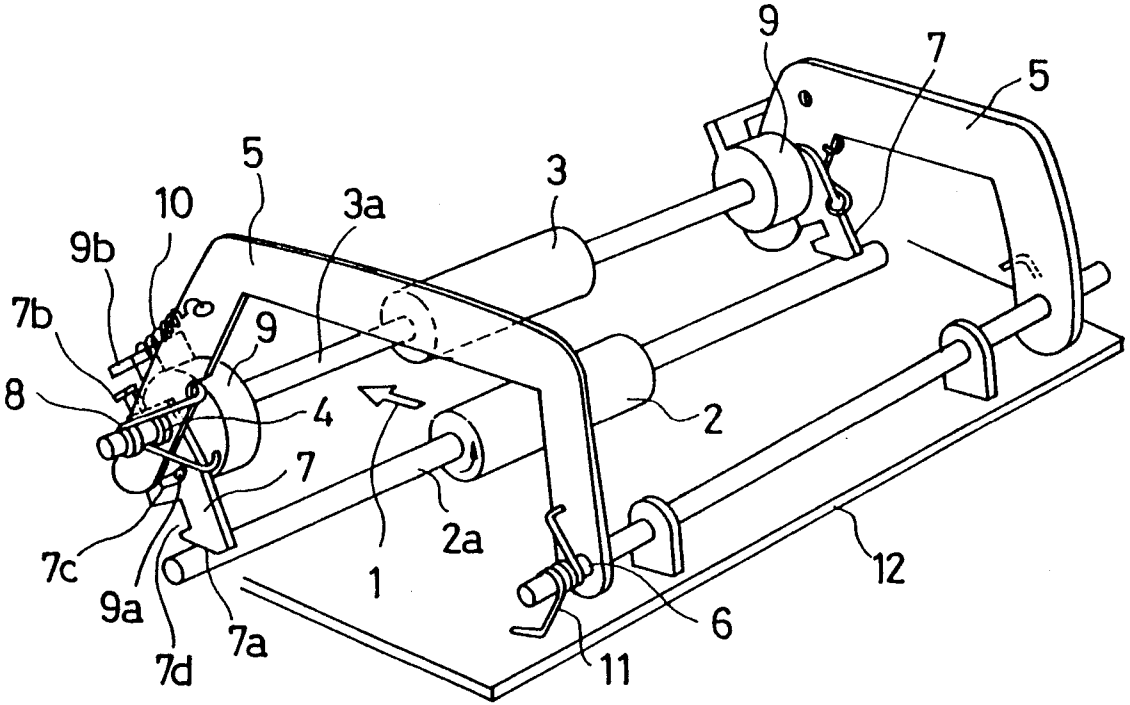
FIG. 1 is an essential perspective view showing one embodiment of the printing medium feeding device according to the present invention.

One embodiment of the present invention will be described in detail with reference to the drawings. Referring to FIG. 1, the arrow 1 indicates a feeding direction of a printing medium. A feed roller 2 is composed of a synthetic rubber and is heat-adhered around a stainless steel shaft 2*a* . A pinch roller 3 is composed of a synthetic rubber and is heat-adhered around a stainless steel shaft 3*a*. Bearings 4 are disposed to rotatably support the pinch roller 3. A pair of arms 5 are disposed to rotatably support the shaft 3*a* of the pinch roller 3 through the bearings 4. A shaft 6 is disposed to pivotably support the pair of arms 5. Each hook 7 is rotatably supported around each end portion of the shaft 3*a* coaxially with the pinch roller 3. The hook 7 is formed at its one end portion with a slanting edge 7*a* and a notch 7*d* engageable with one end portion of the feed roller shaft 2*a*. The hook 7 is formed with a stopper 7*b* at its other end portion and an elongated guide hole 7*c* adjacently disposed to the notch 7*d*. A spring 8 is disposed to urge the hook 7 such that the stopper 7*b* of the hook 7 is normally placed in contact with the arm 5. Actuating means comprised of a holder plate in the form of a boss 9 is provided at each end of the pinch roller shaft 3*a*. Each boss or holder plate 9 is provided therein with power transmission means such as a one-way clutch, and is rotatably supported at each end portion of the pinch roller shaft 3*a*. The boss 9 is formed at its one side with a protrusion 9*a*. The protrusion 9*a* is inserted into the guide hole 7*c* of the hook 7. The elongated guide hole 7*c* is arranged and dimensioned such that the hook 7 can be pivoted to engage with the feed roller shaft 2*a* while the boss 9 is held in a locked state. A stopper 9*b* is formed at one end of the boss 9, and is placed in contact with the arm 5 by means of a bias force from a spring 10. A spring 11 is provided to operate when the hook 7 is disengaged from the feed roller shaft 2*a* for lifting the pinch roller 3 upward. The spring 11 is engaged between the arm 5 and a base of the image reproducing apparatus 12.

Figure 2:
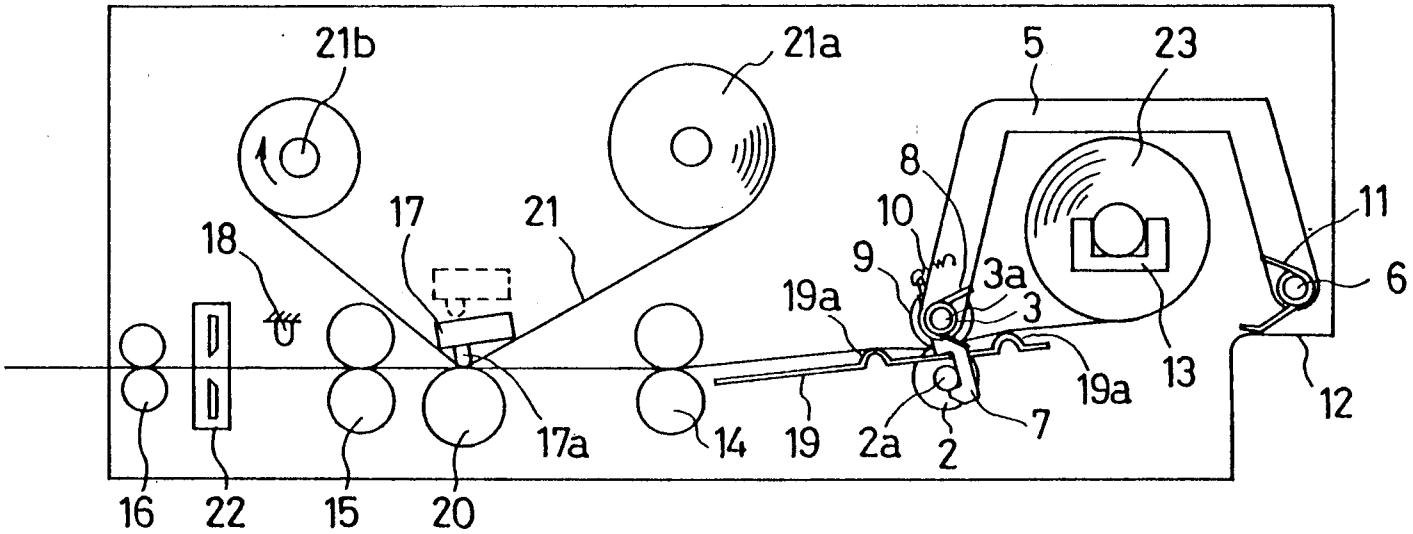
FIG. 2 is a structural sectional view showing an image reproduction apparatus provided with the FIG. 1 feeding device.

Referring to FIG. 2, a frame 13 is disposed to mount thereon a roll of a wound printing medium 23. A pair of guide rollers 14 are provided to guide the printing medium 23 during the course of the feeding operation. A pair of capstan rollers 15 are provided to regulate transfer speed of the printing medium 23 during the printing operation. A pair of discharge rollers 16 are disposed to discharge the printing medium outside the image reproduction apparatus 12 after the image reproduction operation. A thermal head 17 is provided with heating elements 17*a* effective to convert image information into thermal energy. A photosensor 18 is provided to control the sequence of the image reproduction process. A guide plate 19 is formed with a pair of raised portions 19*a* which are disposed separately in the upstream and downstream relative to the feed roller 2 for guiding the printing medium during the feeding thereof. A platen roller 20 is opposed to the thermal head 17. An ink on sheet 21 is composed of a longitudinal resin film coated with an ink one side facing the printing medium 23. The ink sheet 21 is tensioned such that the heating elements 17*a* come into contact with a back face of the ink sheet 21. An ink sheet roller 21*a* is disposed to wind thereabound the longitudinal ink sheet 21 to thereby efficiently store the roll of the ink sheet in the image reproducing apparatus 12. A bobbin 21*b* is provided to retrieve the ink sheet 21. A cutter unit 22 is provided to cut the printing medium 23 in a given size.

Figure 3A:
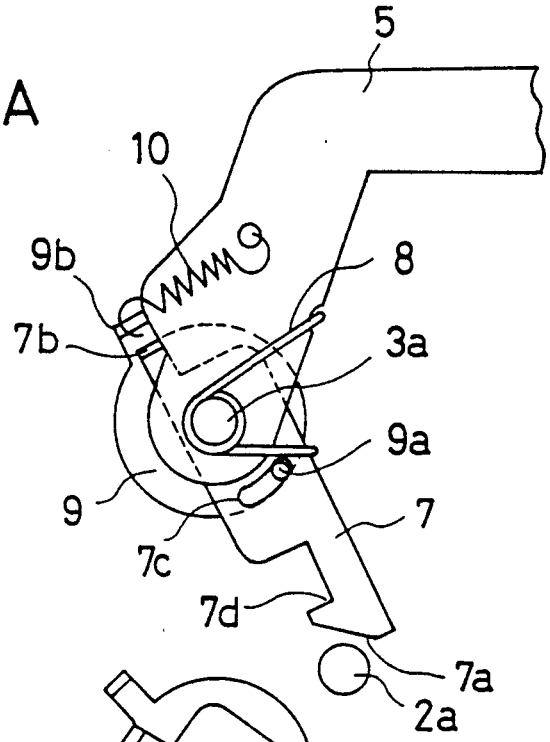
FIGS. 3A, 3B and 3C are diagrams showing operation of the FIG. 1 feeding device.
Figure 3B:
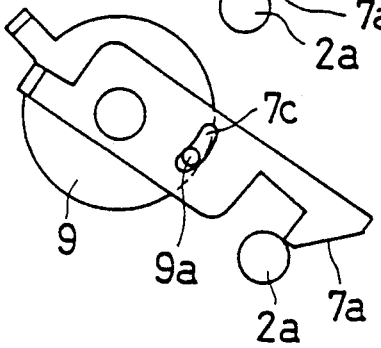
Figure 3C:
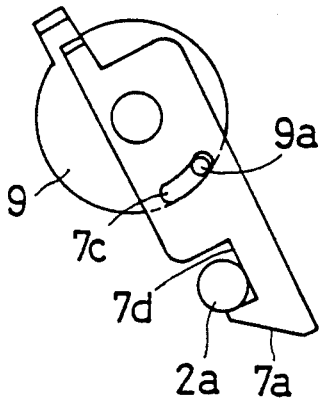

Next, the description is given for the operation of the printing medium feeding device in conjunction with FIGS. 3A, 3B and 3C. The roll of the printing medium 23 is manually mounted on the frame 13, and a top edge of the printing medium 23 is drawn manually to a position provisionally at which the feed roller 2 and the pinch roller 3 are opposed to each other in spaced relation. The arm 5 is manually pivoted counterclockwise around the pivot shaft 6 to move the pinch roller 3 downward. During the course of this operation shown in FIG. 3A, the arm 5 is further pivoted counterclockwise such that the slanting edge 7*a* of the hook 7 comes into contact with the shaft 2*a* of the feed roller 2. Then, the slanting edge 7*a* slides over the shaft 2*a*, while the hook 7 rotates counterclockwise around the shaft 3*a* against the biasing force of the spring 8. When the slanting edge 7*a* has passed over the shaft 2*a* as shown in FIG. 3B, the hook 7 is reversely rotated clockwise by means of the spring 8 so that the notch 7*d* of the hook 7 comes into engagement with the shaft 2*a*. Consequently, the pinch roller 3 is locked to the feed roller 2 so as to sandwich therebetween the printing medium. In this operation, while the hook 7 is rotated counterclockwise until the end of the slanting edge 7*a* runs over the shaft 2*a*, the boss 9 is held stationary such that the stopper 9*b* of the boss is held in contact with the arm 5 by means of the spring 10 because the elongated guide hole 7*c* is dimensioned to avoid abutment with the protrusion 9*a* of the boss 9.

If the elongated guide hole 7*c* were not dimensioned properly so that the protrusion 9*a* were not allowed relative free movement, the edge of the guide hole 7*c* would come into contact with the protrusion 9*a* to thereby rotate the boss 9 counterclockwise, while the arm 5 is manually pivoted counterclockwise to press down the pinch roller 3 so that the hook 7 is pivoted counterclockwise and the slanting edge 7*a* slides over the shaft 2*a*. If the boss 9 were rotated counterclockwise, the pinch roller 3 would be also rotated through the one-way clutch in the boss 9. The rotated pinch roller 3 would come into contact firstly with the feed roller 2 during the course of the downward pivoting of the arm 5. At this moment, the feed roller 2 fixed or stopped though the feed roller 2 is connected to a drive means. Therefore, the pinch roller 3 would be forced to stop rotating instantly when the roller 3 comes into contact with the fixed feed roller 2. Therefore, the boss 9 would be also stopped or caught through the one-way clutch. Consequently, the hook 7 would be also stopped before the hook 7 engages with the feed roller shaft 2*a*. Thus, it would be impossible to sandwich and lock the printing medium between the pinch roller 3 and the feed roller 2. In order to avoid such misoperation, the guide hole 7*c* is dimensioned appropriately to allow free movement of the hook 7.

After the printing medium 23 is interposed between the feed roller 2 and the pinch roller 3 and the pinch roller 3 is locked to the feed roller 2 by means of the hook 7, a feed switch (not shown) is turned on such that a common drive source (not shown) is actuated so as to rotate concurrently the feed roller 2, the pair of guide roller 14, the pair of capstan rollers 15 and the pair of discharge rollers 16 in the same forward direction to thereby transfer the printing medium 23 in the downstream direction. At this moment, the thermal head 17 is positioned as indicated by the dushed line in FIG. 2, hence the printing medium 23 is smoothly transferred. When the printing medium 23 runs over a predetermined distance after the photosensor 18 detect the top edge of the printing medium 23, the drive source is temporarity suspended to stop the feeding of the medium. Thereafter, the drive source is reversely actuated so that the top edge of the printing medium 23 is returned to the position of the capstan roller pair 15 and is then stopped. At this time, in order the avoid loose tensioning of the printing medium 23, to roll of the printing medium 23 is also reversely rotated to wind the printing medium 23 by means of another drive means (not shown).

When this reverse feeding is started, the pinch roller 3 is also reversely rotated in the counterclockwise direction. Concurrently, the boss 9 is also rotated by means of the one-way clutch in the same direction as the pinch roller 3. At this moment, the protrusion 9*a* of the boss 9 pushes the hook 7 counterclockwise in the guide hole 7*c* so that the hook 7 is rotated around the shaft 3*a* to disengage from the shaft 2*a*. Accordingly, the pinch roller 3 is lifted upward clockwise through the arm 5 by means of the spring 11. The guide plate 19 is provided with the pair of separate raised portions 19*a* disposed in the downstream and the upstream with respect to the feed roller 2. The level of the raised portions 19*a* is set higher than the top periphery of the feed roller 2, hence the medium 23 is kept free of contact from both of the feed roller 2 and the lifted pinch roller 3. When the pinch roller 3 is pulled up, the stopper 9*b* of the boss 9 is returned to its stop position relative to the arm 5 by means of the spring 10 as well as the stopper 7*b* of the hook 7 is returned to its stop position in abutment with the arm 5 by means of the spring 8. By such operation, the positioning of the printing medium 23 is finished in the image reproduction apparatus.

Next, when an image reproduction switch (not shown in the drawings) is turned on, the thermal head 17 is lowered as indicated by the solid line in FIG. 2 so that the ink sheet 21 and the printing medium 23 are sandwiched between the platen roller 20 and the heating elements 17*a* of the thermal head 17. After finishing the sandwiching operation, the capstan roller pair 15, the guide roller pair 14 and the discharge roller pair 16 are concurrently rotated in the forward direction to transfer the printing medium 23 to the downstream. The platen roller 20 is freely supported such that the platen roller 20 is rotated along the movement of the printing medium 23. Concurrently, the ink sheet 21 is wound by means of the bobbin 21*b* driven by a drive means (not shown) in the same direction at the same speed as those of the printing medium 23. At this time, the heating elements 17*a* of the thermal head 17 generate heat according to the image information to melt the ink of the sheet 21 from the back face so that the melted ink is sequentially transferred to the printing medium 23 to form the image.

When the image reproduction is finished, the thermal head 17 is retracted to the home position indicated by the dashed line. The ink sheet 21 is wound by the bobbin 21*b* to remove loose tension thereof. The printing medium 23 formed with the image is transferred by a given length through the capstan roller pair 15, the guide roller pair 14 and the discharge a roller pair 16, and is then stopped. The medium 23 is cut by the cutter unit 22 at a given length, and the cut medium 23 is fed out by the discharge roller pair 16. On the other hand, the remaining part of the printing medium 23 is retrieved in the image reproduction apparatus by the reverse rotation of the capstan roller pair 15 and the guide roller pair 14, and by the winding operation of the printing medium roll so that the top edge of the printing medium 23 is reversely transferred to the position of the capstan roller pair 15, which corresponds to the start position of the image forming operation, thereby preparing for a second and subsequent image forming operation. Thus, the sequence of the image forming process is completed.

In summary, the inventive printing medium feeding device is provided in an image production apparatus which forms an image on a printing medium of the longitudinal size such as a roll of the paper sheet or OHP sheet for drawing and feeding the printing medium to a given start position of the printing operation. The printing medium feeding device is characterized by the following constructions:

(1) The feed roller 2 is connected to a drive means for feeding the printing medium 23 bidirectionally in the forward direction indicated by the arrow 1 and in the reverse direction.

(2) The pinch roller 3 is provided to pinch the printing medium 23 against the feed roller 2. The pair of arms 5 are disposed to rotatably support the pinch roller 3 at opposite ends of the roller shaft 3*a*.

(3) The arms 5 are supported pivotably by the support shaft 6 which is remote from the pinch roller shaft 3*a*.

(4) Each hook 7 is rotatably supported at each end portion of the shaft 3*a* coaxially with the pinch roller 3. The hook 7 is formed with the slanting edge 7*a* and the notch 7*d* engageable with the shaft 2*a* of the feed roller 2.

(5) The spring 8 is engaged between the hook 7 and the arm 5 to normally urge the hook 7 to assist in the engagement with the feed roller shaft 2*a*. The stopper 7*b* is formed at the other end of the hook 7 to prevent overrotation of the hook 7 in abutment against the arm 5.

(6) The boss 9 is attached around the pinch roller shaft 3*a* adjacently to the hook 7, and is provided with the one-way clutch rotatable with the pinch roller 3 only when the pinch roller 3 rotates in the reverse direction which is opposite to the feeding direction of the printing medium. The protrusion 9*a* is formed on the one side of the boss 9.

(7) The hook 7 is formed with the guide hole 7*c* which receives therein the protrusion 9*a* of the boss 9. This guide hole 7*c* is dimensioned such that the hook 7 can be pivoted from the disengaged state to the engaged state with respect to the shaft 2*a* while the boss 9 is held stationary. Therefore, the hook 7 can be displaced relative to the boss 9 as long as the protrusion 9*a* can travel freely along the guide hole 7*c*.

(8) The stopper 9*b* is formed at one end of the boss 9. The spring 10 is engaged between the boss 9 and the arm 5 for urging the boss 9 to abut the stopper 9*b* against the arm 5.

(9) When the engagement is released between the hook 7 and the feed roller shaft 2*a*, the spring 11 engaged between the arm 5 and the base of the image reproduction apparatus 12 operates to urge the pinch roller 3 away from the feed roller 2.

In operation according to the invention, firstly the top edge of the printing medium 23 is drawn manually from the roll or web of the sheet medium disposed in the upstream relative to the feed roller 2 and the pinch roller 3. The drawn top edge of the printing medium is placed between the pinch roller 3 and the feed roller 2, which are spaced from each other provisionally. Then, the arms 5 are pushed downward manually around the pivot shaft 6 to lower the pinch roller 3 so that the hook 7 is rotated around the coaxial shaft 3*a* while the slanting edge 7*a* of the hook 7 slides over the feed roller shaft 2*a* in contact therewith. When the slanting edge 7*a* has passed over the shaft 2*a*, the notch 7*d* of the hook 7 comes into engagement with the shaft 2*a* by means of the spring 8. Consequently, the printing medium is sandwiched firmly between the feed roller 2 and the pinch roller 3. During the course of this rotation of the hook 7, the boss 9 is held stationary without rotation because the protrusion 9*a* is loosely engaged with the guide hole 7*c* of the hook 7 to allow free rotation of the hook 7.

If the protrusion 9*a* of the boss 9 were closely fitted into the elongated guide hole 7*c* of the hook 7, an edge of the guide hole 7*c* would abut with the protrusion 9*a* to rotate the boss 9 concurrently when the slanting edge 7*a* of the hook 7 comes into contact with the shaft 2*a* to slide thereover. Accordingly, the pinch roller 3 would also rotate in the same direction as the hook 7 through the one-way clutch. If the pinch roller 3 were further pressed downward, the pinch roller 3 would firstly abut with the feed roller 2. Since the feed roller 2 connected to the drive means is fixed stationary at this moment, the rotation of the pinch roller 3 would be stopped instantly at the abutment against the fixed feed roller 2. On the other hand, the boss 9 could not return to the initial position due to the locking function of the one-way rotary clutch, and the rotation of the hook 7 would be interrupted so that the hook 7 would fail to engage with the shaft 2*a*. Therefore, the printing medium 23 could not be sandwiched firmly and stably between the feed roller 2 and the pinch roller 3. In order to avoid such misoperation, the enlongated guide hole 7*c* is dimensioned suitably such that the hook 7 can be pivoted from the disengaged state to the engaged state relative to the shaft 2*a* while the boss 9 is fixed stationary.

Then, a feed switch (not shown) is turned on to feed further by a given distance the printing medium 23 sandwiched between the feed roller 2 and the pinch roller 3 in the downstream beyond an operation start point of the image reproduction apparatus. In order to effect this forward feeding of the printing medium 23, the drive means is operated to rotate forward the feed roller 2 so that the pinch roller 3 is also rotated to follow the rotation of the feed roller 2. At this moment, the boss 9 is held stationary by means of the one-way clutch. Then, the printing medium 23 is reversed by a given length which corresponds to a margin of the operation sequence of the printing medium feeding device in the image reproduction apparatus, to the operation start point of the apparatus. During the course of this reverse feeding, the feed roller 2 is reversely rotated, and the pinch roller 3 is also accordingly rotated reversely. When the pinch roller 3 is rotated reversely, the boss 9 is rotated in the same direction as the pinch roller 3 by means of the one-way rotary clutch. Consequently, the protrusion 9*a* of the boss 9 pushes the hook 7 in the guide hole 7*c* so that the hook 7 is also pivoted in the same direction to thereby disengage from the feed roller shaft 2*a*. Upon this disengagement, the arm 5 is lifted upward by means of the spring 11 so that the pinch roller 3 is also lifted upward away from the printing medium 23. The hook 7 is returned to its home position by the spring 8, and the boss 9 is returned to its home position by the spring 10.

As described above, the image reproduction apparatus is provided with the inventive printing medium feeding device operative to release the feed roller 2 and the pinch roller 3 from each other while securing low cost performance and high reliability, thereby avoiding undesirable affect to the image quality.

In this embodiment, the image reproduction apparatus is comprised of a thermal transfer printer. However, the present invention can be applied various types of printers such as an ink jet type, electronic photography type and a wire dot type, add can be applied various kinds of image reproduction apparatus such as a facsimile machine and a copy machine. It is only necessary that the image forming medium is stored in the form of a roll or web. Further, the guide hole *7c* of the hook 7 can be formed in various shapes such as a round opening, a rectangular opening and a mere recess. It is only required that the guide hole *7c* is dimensioned suitably such as to enable the hook 7 to shift from the disengaged state to the engaged state relative to the shaft *2a* while leaving the protrusion *9a* of the boss 9 stationary.

As described above, according to the present invention, in the printing medium feeding device, the pinch roller is pressed firmly to the feed roller to effect feeding of the printing medium in the image reproduction apparatus, while the pinch roller is released from the feed roller during the printing operation to eliminate bad affect to the image quality, with low cost performance and high reliability.

What is claimed is:

1. A printing medium feeding device of an image reproduction apparatus provided with a pair of a feed roller and a pinch roller for sandwiching a printing medium, and drive means for rotating the feed roller bidirectionally in a forward direction and a reverse direction, the device comprising:

arm means having one end portion arranged to rotatably support end portions of a shaft of the pinch roller and having another end portion at which the arm means is pivotably supported on the image reproduction apparatus;

spring means for normally urging the pinch roller away from the feed roller;

engaging means supported rotatably around the shaft of the pinch roller and having at one end portion thereof a guide hole and a notch for engaging with a shaft of the feed roller, the engaging means being biased normally in a direction for engagement with the feed roller shaft; and a holder plate having a power transmission means and being supported around the pinch roller shaft and having on one side thereof a protrusion inserted freely into the guide hole of the engaging means such that when the pinch roller is reversely rotated the holder plate is rotated in the same direction accompanied with the engaging means so as to enable the engaging means to rotate in the same direction to release the engagement from the feed roller shaft, the holder plate being biased to contact at its one end portion with the arm means when the engaging means is held stationary in its home position.

2. A printing medium feeding device according to claim 1; wherein the arm means includes means manually operable for pushing downward the pinch roller to the feed roller to effect engagement of the engaging means to the feed roller shaft.

3. A printing medium feeding device according to claim 1; wherein the power transmission means comprises a one-way clutch; and the guide hole of the engaging means is elongated and dimensioned to enable the engaging means to pivot from a disengaged state to an engaged state relative to the feed roller shaft while the holder plate is held stationary.

4. A printing medium feeding device for an image reproduction apparatus, comprising: a pinch roller mechanism; a feed roller mechanism; driving means for driving the feed roller mechanism in a forward direction and a reverse direction; engaging means for engaging with the feed roller mechanism and operative when in an engaged position to pinch a printing medium between the pinch roller mechanism and the feed roller mechanism so that the pinch roller mechanism is rotated by the rotation of the feed roller mechanism; and rotatable actuating means having a one-way transmission to allow rotation of the actuating means by the pinch roller mechanism when the feed roller is driven in the reverse direction so that the actuating means actuates the engaging means to release the engagement with the feed roller mechanism.

5. A printing medium feeding device according to claim 4; including biasing means for biasing the pinch roller mechanism away from the feed roller mechanism.

6. A printing medium feeding device according to claim 4; including supporting means comprising at least one arm member for rotatably supporting the pinch roller mechanism.

7. A printing medium feeding device according to claim 6; wherein the engaging means is pivotally supported by at least one of the supporting means and the pinch roller mechanism; and means mounting the arm member to undergo manual pivotable movement to bring the engaging means into the engaged position.

8. A printing medium feeding device according to claim 4; wherein the engaging means is rotatably supported by the pinch roller mechanism and comprises at least one hook member for hooking onto the feeding roller mechanism in the engaged position.

9. A printing medium feeding device according to claim 8; wherein the actuating means has a protrusion; and the hook includes a guide hole for receiving the protrusion, the guide hole being dimensioned so that the hook is pivoted from a disengaged state to an engaged state with the feed roller mechanism while the actuating means remains stationary.

* * * * *